US005556736A

United States Patent [19]

Haraguchi et al.

[11] Patent Number: 5,556,736

[45] Date of Patent: Sep. 17, 1996

[54] METHOD FOR PROCESSING A SILVER HALIDE COLOR PHOTOGRAPHIC LIGHT-SENSITIVE MATERIAL AND PRODUCING A COLOR IMAGE

[75] Inventors: Tsuyoshi Haraguchi; Ichiro Tsuchiya, both of Hino, Japan

[73] Assignee: Konica Corporation, Tokyo, Japan

[21] Appl. No.: 326,094

[22] Filed: Oct. 19, 1994

[30] Foreign Application Priority Data

Nov. 11, 1993 [JP] Japan ..... 5-282686

[51] Int. Cl.[6] ..... G03C 5/18; G03C 5/26

[52] U.S. Cl. ..... 430/399; 430/403; 430/442; 430/465; 430/467

[58] Field of Search ..... 430/399, 403, 430/442, 465, 467

[56] References Cited

U.S. PATENT DOCUMENTS

| | | | |
|---|---|---|---|
| 2,196,901 | 4/1940 | Ham | 430/465 |
| 2,313,523 | 3/1943 | Donovan et al. | 430/465 |
| 2,394,588 | 2/1946 | Benn | 430/465 |
| 2,649,376 | 8/1953 | Rasch et al. | 430/465 |
| 3,158,482 | 11/1964 | Lucas | 430/465 |
| 4,029,510 | 6/1977 | Speers | 430/399 |
| 4,159,245 | 6/1979 | Matsushita et al. | 430/399 |
| 4,816,384 | 3/1989 | Fruge et al. | 430/465 |
| 4,839,273 | 6/1989 | Yamada et al. | 430/399 |
| 4,920,041 | 4/1990 | Ohki et al. | 430/467 |
| 4,988,448 | 1/1991 | Woog | 430/399 |
| 4,997,749 | 3/1991 | Wernicke et al. | 430/399 |
| 5,071,734 | 12/1991 | Ueda et al. | 430/399 |
| 5,240,822 | 8/1993 | Tanaka et al. | 430/465 |
| 5,278,036 | 1/1994 | Kobayashi et al. | 430/465 |
| 5,334,492 | 8/1994 | Wernicke et al. | 430/399 |
| 5,336,588 | 8/1994 | Ueda | 430/465 |
| 5,460,926 | 10/1995 | Komatsu et al. | 430/399 |

FOREIGN PATENT DOCUMENTS

| | | | |
|---|---|---|---|
| 0416585 | 3/1991 | European Pat. Off. | 430/399 |
| 0488233A1 | 6/1992 | European Pat. Off. . | |
| 0537365A1 | 4/1993 | European Pat. Off. . | |
| 0542283A1 | 5/1993 | European Pat. Off. . | |
| 0595312A1 | 5/1994 | European Pat. Off. . | |
| 0611987A1 | 8/1994 | European Pat. Off. . | |
| 5-100370 | 4/1993 | Japan | 430/465 |
| 6-19094 | 1/1994 | Japan | 430/399 |
| 9107698 | 5/1991 | WIPO | 430/399 |

*Primary Examiner*—Charles L. Bowers, Jr.
*Assistant Examiner*—J. Pasterczyk
*Attorney, Agent, or Firm*—Frishauf, Holtz, Goodman, Langer & Chick, P.C.

[57] ABSTRACT

A method for processing an exposed silver halide color photographic photosensitive material is disclosed, which comprises the step of developing the exposed material with a color developer in a color development tank of an automatic developing apparatus, the developer in the developer tank being replenished with replenishing water and a solid color developing composition comprising a p-phenylenediamine color developing agent having a water-solubilizing group, wherein the replenishing amount of the water is 30 to 75 ml per $m^2$ of the material processed and the replenishing amount of the color developing agent is 0.024 to 0.066 mol per liter of the replenishing amount of the water.

14 Claims, 4 Drawing Sheets

METHOD FOR PROCESSING A SILVER HALIDE COLOR PHOTOGRAPHIC LIGHT-SENSITIVE MATERIAL AND PRODUCING A COLOR IMAGE

FIELD OF THE INVENTION

The invention relates it to a method for processing a silver halide color photographic light-sensitive material and a method for producing a color photographic image.

BACKGROUND OF THE INVENTION

A silver halide color photographic light-sensitive material has photographically been processed with a processing solution using an automatic processing machine. On such occasions, a replenisher replenishing system is commonly used wherein the processing solution in a processing tank is controlled so that the activity thereof is kept constant. In the case of the replenisher replenishing system, processing agents are dissolved to prepare a replenishing solution, and the solution is replenished so that the processing agents are replenished.

However, since the solution replenishing produces overflow solution corresponding to the replenishing amount except for the evaporated amount, much overflow solution as photographic waste is ordinarily discharged. This is a problem, since there has been recent world wide movement for regulations to prohibit dumping of photographic waste into oceans.

On the other hand, a method to reduce the waste by regenerating the processing solution is disclosed in WO91-07698 or WO91-07699. However, in this method the apparatus for the regeneration is necessary besides the processing machine, and its system is complex and large.

Therefore, a less replenishment method reducing a replenisher has been developed in order to reduce the photographic waste. However, even if a light-sensitive material is processed in this replenishment method, the amount of the processing components consumed and replenished are not changed. Therefore, the replenisher has been concentrated. As a result, recently the replenisher is so concentrated as to reach the solubility limit of the processing agent. Accordingly, a further reduced replenishment method has problems such as poor storage stability of the replenisher or occurrence of precipitations in the replenisher, and it is impossible to further reduce the waste by such replenishment of the replenisher.

Recently, a solid processing composition has been developed for the processing composition for a silver halide photographic light-sensitive material. There is disclosed a method, for example, in Japanese Patent O.P.I. Publication No. 5-119454 that all processing components are solidified and are incorporated directly to the processing tank to replenish the processing components. There is also disclosed a method in Japanese Patent O.P.I. Publication No. 4-213454 that powdered processing components are incorporated at a portion communicating with the processing tank to reduce the amount of the replenishing water.

However, the present inventors have found that when reduced amount of replenishing water is replenished using a solid processing composition (particularly, the replenishing amount of replenishing water is not more than 75 ml per $m^2$ of a silver halide color photographic light-sensitive material processed), surprisingly the following problems occurred.

Firstly, less replenishment of water does not give the maximum density as photographic property and produces stains in unexposed portions. As a result, optimum photographic properties can not be obtained.

Secondly, less replenishment of water causes crystal deposits on the the processing tank walls or the racks and produces tars.

Thirdly, less replenishment of water causes localized high concentration of the processing components in the processing solution, and precipitation readily occurs.

Fourthly, while the replenishing amount of water is preferably less in view of reduction of waste or earth environmental protection, it is necessary to replenish water to some extent. Otherwise, the surface of the processing solution in the processing tank is lowered, and portions which usually are under the solution surface are exposed to the air, crystal deposits are produced in those portions, accumulation of components unnecessary for processing is promoted and stains are produced on the light-sensitive material.

There is no description in the aforementioned references that the replenishing amount of replenishing water is not more than 75 ml per $m^2$ of a silver halide color photographic light-sensitive material processed. There is no description in the above references regarding the aforementioned problems or a method solving the above problems and stably attaining reduced replenishment water which the conventional replenishing method replenishing a replenisher could not attain.

SUMMARY OF THE INVENTION

An object of the invention is to solve the above mentioned problems, stably obtain for an extended time a color photographic image having a sufficient maximum density and minimal stains, lessen the occurrence of crystals or tars, and enable greatly reduced replenishment of water which can not be attained by the conventional replenishing method employing a liquid replenisher.

DETAILED DESCRIPTION OF THE INVENTION

Figure 1:
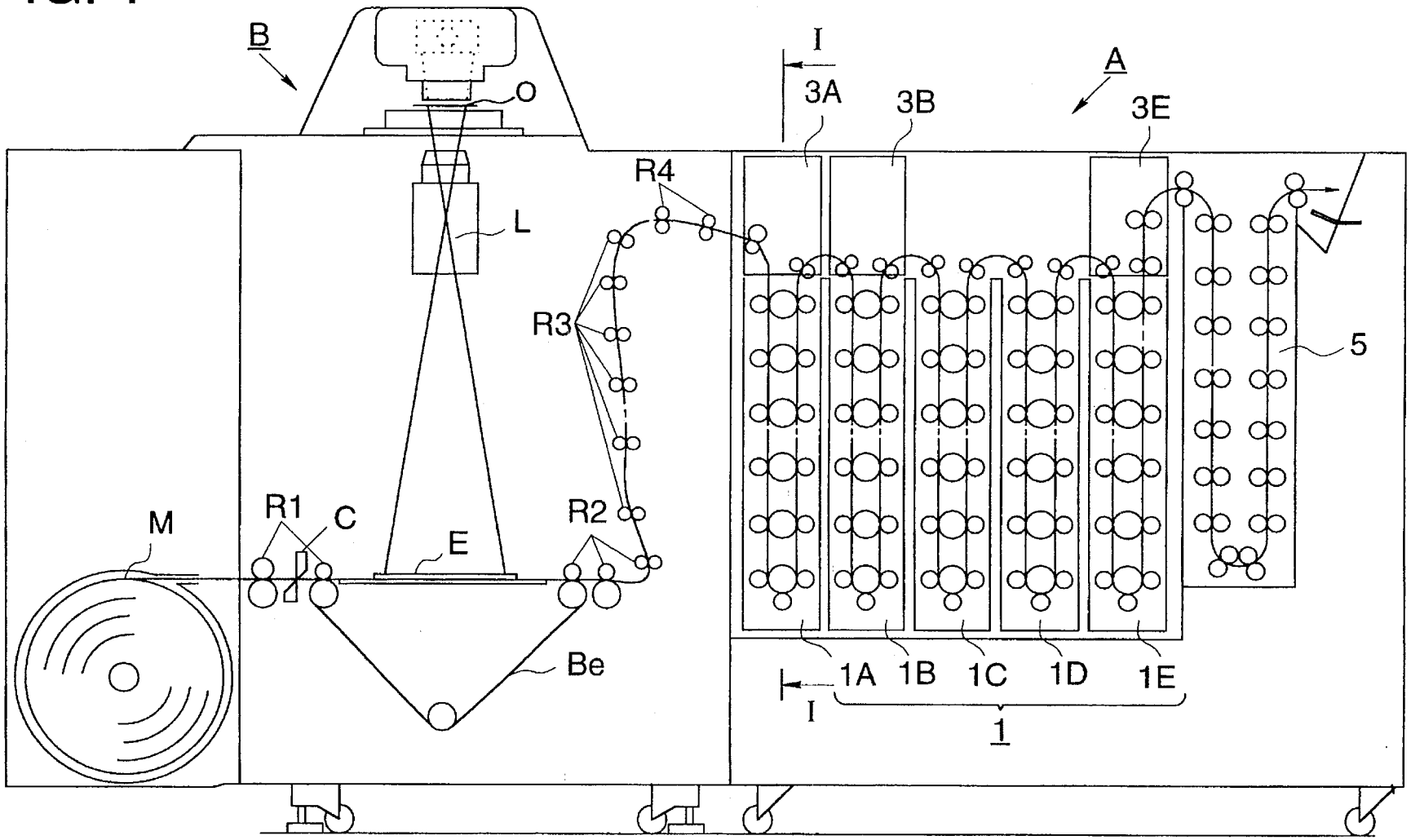
FIG. 1 is a schematic arrangement view of the silver halide photosensitive material processing apparatus.

The above object is attained by the following method according to the invention.

(Item 1) A method for processing a silver halide color photographic photosensitive material using an automatic developing apparatus including a color developer tank, comprising the step of;

developing the material with a color developer, the developer in the developer tank being substantially directly replenished with replenishing water and a solid color developing composition comprising a p-phenylenediamine color developing agent having a water-solubilizing group, wherein the replenishing amount of the water is 30 to 75 ml per $m^2$ of the material to be processed and the replenishing amount of the color developing agent is 0.024 to 0.066 mol per liter based on the replenishing amount of water.

(Item 2) The method of Item 1, wherein the developer comprises the p-phenylenediamine color developing agent in an amount of 0.011 to 0.066 mol per liter.

(Item 3) The method of claim 2, wherein the developer comprises the p-phenylenediamine color developing agent in an amount of 0.016 to 0.062 mol per liter.

(Item 4) The method of Item 3, wherein the developer in the developer tank comprises the p-phenylenediamine color developing agent in an amount of 0.018 mol per liter.

(Item 5) The method of Item 1, 2, 3 or 4, wherein the solid color developing composition is in granule, tablet or pellet form.

(Item 6) The method of Item 1, 2, 3, 4 or 5, wherein the replenishing amount of the solid color developing composition is 0.1 to 50 g per time.

(Item 7) The method of Item 1, 2, 3, 4, 5 or 6, wherein the p-phenylenediamine color developing agent is a compound represented by the following Formula (I):

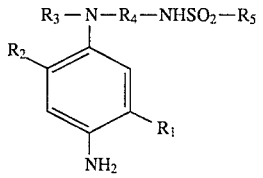

Formula (I)

wherein $R_1$ and $R_2$ independently represent a hydrogen atom, an alkyl group an alkoxy group or an acylamino group; $R_3$ represents an alkyl group; $R_4$ represents an alkylene group; and $R_5$ represents a substituted or unsubstituted alkyl or aryl group.

(Item 8) The method of Item 1, 2, 3, 4, 5, 6 or 7, wherein the material comprises a silver halide emulsion comprising not less than 80 mol % of silver chloride in silver halide composition.

(Item 9) The method of claim 1, 2, 3, 4, 5, 6, 7 or 8, wherein the solid color developing composition further comprises a compound represented by the following Formula (2):

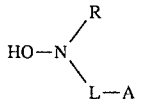

Formula (II)

wherein L represents an alkylene group; A represents a carboxyl group, a sulfo group, a phosphono group, a phosphinic acid group, a hydroxyl group, an amino group, an ammonio group, a carbamoyl group or a sulfamoyl group; and R represents a hydrogen atom or an alkyl group, provided that L, A and R may be straight-chained or branched or may have a substituent and R and L may combine each other to form a ring.

(Item 10) The method of Item 1, 2, 3, 4, 5, 6 or 7, wherein the temperature of the color developer in the color developer tank is controlled to be within a predetermined range when the solid color,developing composition is incorporated in the color developer.

(Item 11) The method of Item 1, 2, 3, 4, 5, 6, 7, 8, 9 or 10, wherein the solid color developing composition is supplied to the color developer tank based on the information of the processed amount of the material.

(Item 12) The method of Item 1, 2, 3, 4, 5, 6, 7, 8, 9, 10 or 11, wherein the color developer in the color developer tank is circulated.

(Item 13) The method of Item 12, wherein the color developer is filtered by a filter provided in a passage through which the developer is circulated.

(Item 14) The method of Item 13, wherein the solid color developing composition is supplied to the passage before the color developer is filtered.

(Item 15) A method for producing a color photographic image comprising processing an imagewise exposed silver halide color photographic photosensitive material using an automatic developing apparatus having a color developer tank, comprising the steps of; developing the material with a color developer, the developer in the color developer tank being substantially directly replenished with replenishing water and a solid color developing composition comprising a p-phenylenediamine color developing agent having a water-solubilizing group, wherein the replenishing amount of the water is 30 to 75 ml per $m^2$ of the material to be processed and the replenishing amount of the color developing agent is 0.024 to 0.066 mol per liter based on the replenishing amount of water.

The invention will be detailed below.

The solid processing composition of the invention refers to the solid processing composition such as the above-described powdered processing components, tablets, pellets or granules, and may optionally be subjected to moisture-proof treatment.

The powder referred to in the invention is an aggregation of fine crystals. The granules referred to in the invention are obtained by granulating the powder, and these granules preferably have a particle size within the range of 50 to 5000 μm. The tablets referred to in the invention are one obtained by compression-molding powder or granules into a definite form. The pellets referred to in the invention are one molding in a roundish form (including a potato or spherical form) by granulating or tableting powder or granules. Of these solid compositions the granules, tablets and pellets are preferable in that they are free from loosen powder and have high incorporation reliability. Of these, the tablets are preferably used since they exhibit the effects of the invention that they are high in replenishing reliability, simple in handling and free from quick concentration variation due to rapid dissolution.

In order to solidify a photographic processing composition, any means can be applied, including means that its concentrated solution, powder or granules is kneaded with a water soluble binder and molded or the water soluble binder is sprayed on its surface of a contemporarily molded composition to form a cover layer. (See Japanese Patent O.P.I. Publication Nos. 4-29136, 4-85533-85536 and 4-172341.

The preferable method of tablets is a method granulating a powdered solid processing composition and then tableting the granules. This method has an advantage that solubility or storage stability are improved and photographic properties are stable as compared with the method simply mixing and then tableting the solid processing composition. As for the granulating processes for forming tablets, granules or pellets, it is possible to use any of the well-known processes such as the processes of a rolling granulation, an extrusion granulation, a compression granulation, a cracking granulation, a stirring granulation, a fluidized-layer granulation and a spray-dry granulation. On granulating, the addition of 0.01–20% by weight of a water soluble binder makes the effects of the invention more remarkable. The example of the water soluble binder includes celluloses, dextrins, sugar alkohols, polyethylene glycols and cyclodextrins.

On preparing tablets by compressing the obtained granules, the well known compressors such as a hydraulic press machine, a single tableting machine, a rotary tableting machine and a bricketing machine can be used. The granules are preferably one obtained by granulating each component such as an alkali agent or a preservative separately, whereby the above described effects are remarkable.

A tablet type processing composition can be prepared in any well known process or the method detailed in JP OPI Publication Nos. 51-61837/1976, 54-155038/1979 and 52-88025/1977 and British Patent No. 1,213,808. Also, the preparation of the granulated processing composition is detailed in JP OPI Publication Nos. 2-109042/1990, 2-109043/1990 , 3-39735/1991 and 3-39739/1991. Further, a powder type processing composition can be prepared in any well known process as detailed in JP OPI Publication No. 54-133332/1979, British Patent Nos. 725,892 and 729,862 and German Patent No. 3,733,861.

In the invention the supplying method of the solid processing composition, for example, tablets, includes the well-known method disclosed in Japanese Utility Model O.P.I. Publication Nos. 63-137783, 63-97522 and 1-85732 and may be any of those capable of supplying the tablets. In the case of granules or powder, the supplying method of the solid processing composition includes the gravity method disclosed in Japanese Utility Model O.P.I. Publication Nos. 62-81964 and 63-84151 and Japanese Patent O.P.I. Publication No. 1-392375 or the screw method disclosed in Japanese Utility Model O.P.I. Publication Nos. 63-105159 and 63-195345, but is not limited thereto.

When the solid processing composition is replenished, it is introduced to the processing tanks and preferably to a passage which communicates with the processing tanks, wherein the processing solution is circulated from the tanks through the passage. The processing tanks preferably have a section for dissolving the solid composition which is connected to the tanks and have a definite amount of a circulating solution and have a structure through which the dissolved components move to the processing tanks. The solid processing composition is preferably introduced to temperature regulated processing solutions.

The incorporation amount of the solid processing composition per time is preferably not less than 0.1 g in view of the effect of the invention, durability of the incorporation device and accuracy of incorporation, and more preferably not more than 50 g in view of the effect of the invention and dissolution time.

The replenishing water of the invention refers to water supplied to the processing tank according to the amount of processed light-sensitive materials and does not substantially include water supplied to compensated for evaporation water. Accordingly, the replenishing amount of the replenishing water in the invention refers to the amount the evaporated water subtracted from the total amount of water supplied to the processing tank.

When the replenishing amount of the replenishing water is not less than 30 ml per $m^2$ of the light-sensitive material, it is preferable in that the surface of the processing solution in the processing tank is difficult to be lowered, the time necessary to process is obtained, no adverse influence on photographic properties are observed, and there is less crystal deposition due to unnecessary component accumulation in the processing solution and less staining on the light-sensitive materials. When the replenishing amount of the replenishing water is not more than 75 ml per $m^2$ of the light-sensitive material, it is preferable in that the replenishing water and waste solution are reduced to contribute to less pollution as compared with the conventional replenisher replenishing method. The replenishing amount of the replenishing water is preferably not less than 35 ml/$m^2$ (more preferably not less than 40 ml/$m^2$), and preferably not more than 70 ml/$m^2$ (more preferably not more than 60 ml/$m^2$).

The replenishing amount of the p-diphenylamine color developing agent in the solid processing composition is 0.024 to 0.066 mol/liter based on the replenishing amount of the replenishing water, whereby the object of the invention is attained. The replenishing amount of the p-diphenylamine color developing agent is preferably 0.028 to 0.062 mol/liter, and more preferably 0.033 to 0.048 mol/liter, whereby the effect of the invention is markedly displayed. It is preferable in that when the above replenishing amount is not less than the above minimum replenishing amount, the replenishing water and waste solution are reduced obtaining a sufficient photographic density. On the other hand, it is preferable in that when the above replenishing amount is not more than the above maximum replenishing amount, crystal deposits and precipitations due to solubility limit of the component such as the p-diphenylamine color developing agent are difficult to occur.

The color developing agent of the invention is a p-phenylene diamine compound having a water solubilizing group. The above-described p-phenylenediamine compound has at least one water solubilizing group on its amino group or benzene ring. The examples of the water solubilizing group include $-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ (m and n independently represent an integer of not less than 0), —COOH and $-SO_3H$.

Exemplified compounds of the p-phenylenediamine compounds preferably used in the present invention include the following compounds (C-1) through (C-18).

(Exemplified compounds)

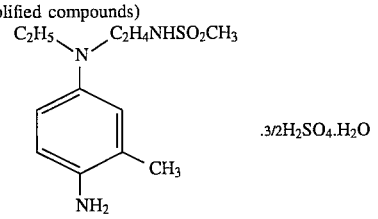

(C-1)

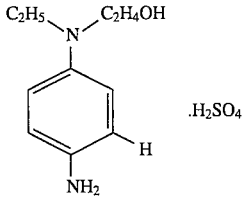

(C-2)

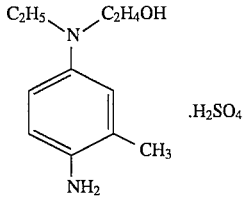

(C-3)

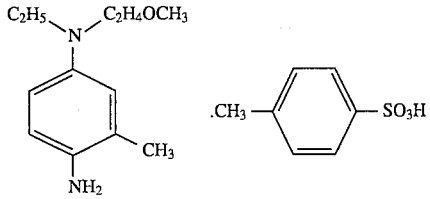

(C-4)

-continued (C-5)

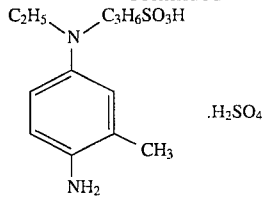

(C-6)

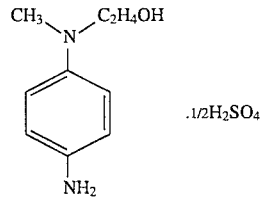

(C-7)

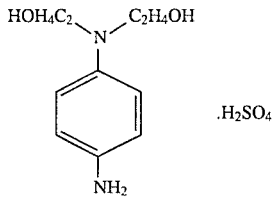

(C-8)

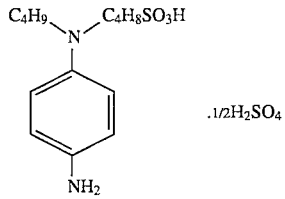

(C-9)

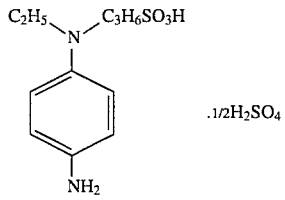

(C-10)

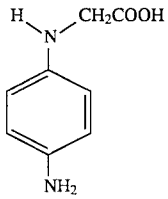

(C-11)

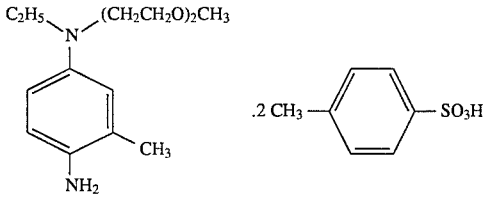

(C-12)

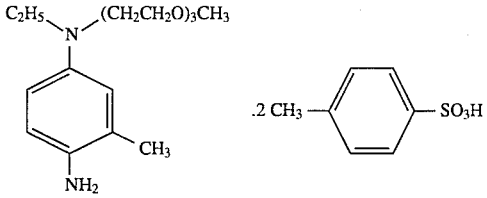

-continued (C-13)

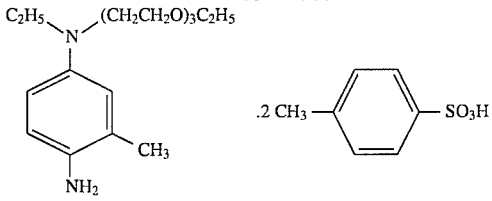

(C-14)

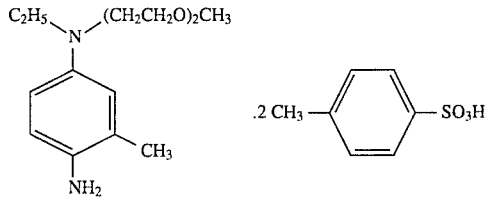

(C-15)

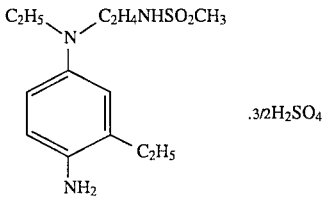

(C-16)

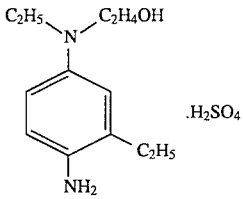

(C-17)

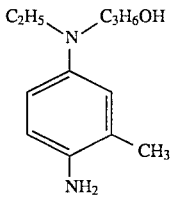

(C-18)

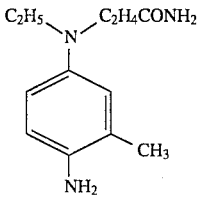

Of the above exemplified p-phenylenediamine compounds Exemplified compounds (C-1), (C-2), (C-3), (C-4), (C-15), (C- 17) and (C-18) are preferable.

The color developing agent, which markedly displays the effects of the invention and is preferably used, is a p-phenylene diamine compound having a water solubilizing group represented by the following Formula (I).

Formula (I)

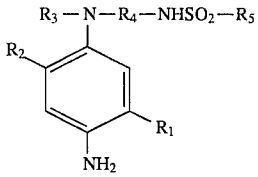

The examples of the compound, besides the above, include the following compounds (C-19) through (C-35). The examples are given below by showing concretely the groups of $R_1$ through R.

| | $R^1$ | $R^2$ | $R^3$ | $R^4$ | $R^5$ |
|---|---|---|---|---|---|
| C-19 | —H | —H | $—C_3H_7$ | $—CH_2CH(—CH_3)—$ | $—CH_3$ |
| C-20 | $—NHCOCH_3$ | —H | $—CH_3$ | $—CH_2CH_2—$ | $—CH_3$ |
| C-21 | —H | —H | $—CH_3$ | —CH2CH(—CH3) — | $—CH_3$ |
| C-22 | $—CH_2CH_3$ | —H | $—CH_3$ | $—CH_2CH_2—$ | $—CH_3$ |
| C-23 | $—CH_3$ | —H | $—CH_3$ | —CH2CH(—CH3) — | $—CH_2CH_3$ |
| C-24 | $—CH_3$ | —H | $—CH_3$ | $—CH_2CH_2—$ | $—CH_2CH_3$ |
| C-25 | $—O—CH_2CH_3$ | —H | $—CH_2CH_3$ | $—CH(—CH_3)CH_2—$ | $—CH_3$ |
| C-26 | $—NHCOCH_3$ | —H | $—C_3H_7$ | $—CH_2CH_2—$ | $—CH_3$ |
| C-27 | $—CH_3$ | —H | $—CH_2CH_3$ | $—CH_2CH_2—$ | $—CH_2—O—CH_3$ |
| C-28 | —H | —H | $—CH_3$ | $—CH_2CH_2—$ | $—CH_2—N—(CH_3)_2$ |
| C-29 | $—CH_3$ | —H | $—CH_2CH_3$ | $—CH_2CH_2—$ | $—CH_2Cl$ |
| C-30 | $—CH_3$ | —H | $—CH_2CH_3$ | $—CH_2CH_2—$ | —CH2—NHCO—$CH_3$ |
| C-31 | $—CH_2CH_3$ | —H | $—CH_2CH_3$ | $—CH_2CH_2—$ | $—CH_2—O—CH_3$ |
| C-32 | $—CH_3$ | —H | $—CH_2CH_3$ | $—CH_2CH_2—$ | $—CH_2—O—CH_2CH_3$ |
| C-33 | $—CH_3$ | —H | $—CH_2CH_3$ | $—CH_2CH_2CH_2—$ | $—CH_3$ |
| C-34 | —Cl | —H | $—CH_3$ | $—CH_2CH_2CH_2—$ | $—CH_3$ |
| C-35 | $—O—CH_3$ | —H | $—CH_2CH_3$ | —CH2CH(—CH3)— | $—CH_3$ |

Of these exemplified compounds, the preferable are (C-20), (C-27), (C-28), (C-29), (C-30) and (C-33), and the most preferable are (C-1). The synthetic method of the compounds of the invention represented by Formula (I) can be performed with reference to the synthesis procedures described in Japanese Patent O.P.I. Publication No. 4-37198. These color developing agents are usually used in a form of a hydrochloride, sulfate or p-toluenesulfonate salt.

The above-mentioned color developing agents may be used singly or in combination of two kinds and may optionally be used together with black-and-white developing agents such as phenidone, 4-hydroxymethyl-4-methyl-1-phenyl-3-pyrazolidone and metol.

In the invention when a compound represented by the following Formula (A) or (B) is contained in the solid color developing composition of the invention, the effects of the invention can further be displayed. That is, when it is solidified, it has an advantage that shows an excellent storage stability of the solid composition such as tablets, stable photographic properties and less fog in unexposed areas as compared with other compounds.

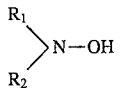

Formula (A)

In Formula (A) $R_1$ and $R_2$ independently represents a hydrogen atom, an alkyl group, an aryl group or R'CO—, provided that $R_1$ and $R_2$ are not simultaneously hydrogen atoms and the alkyl group represented by $R_1$ or $R_2$ may be the same or the different. $R_1$ and $R_2$ preferably represent an alkyl group having 1 to 3 carbon atoms, which may have a carboxyl group, a phosphoric acid group, a sulfonic acid group or a hydroxyl group. R' represents an alkoxy group, an alkyl group or an aryl group. The alkyl or aryl group of $R_1$, $R_2$ or R' includes one having a substituent and $R_1$ and $R_2$ may combine to form a ring or a heterocyclic ring such as piperidine, pyridine, triazine or morphorine.

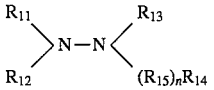

Formula (B)

In Formula (B) $R_{11}$, $R_{12}$ and $R_{13}$ independently represent a hydrogen atom, a substituted or non-substituted alkyl, aryl or heterocyclic group; $R_{14}$ represents a hydroxyl group, a hydroxyamino group or a substituted or non-substituted alkyl, aryl, heterocyclic, alkoxy, aryloxy, carbamoyl or amino group. The heterocyclic groups have each a 5- or 6-membered ring. They are comprised of C, H, O, N, S or halogen atom and may also be saturated or unsaturated; $R_{15}$ represents a divalent group selected from the group consisting of —CO, $—SO_2—$ or —C(=NH)—; and n is an integer of 0 or 1, provided that, when n=0, $R_{14}$ represents a group selected from the group consisting of alkyl groups, aryl groups and heterocyclic groups and that $R_{13}$ and $R_{14}$ may also be associated to form a heterocyclic ring.

The typical examples of the hydroxyl amine type compounds represented by the foregoing Formula (A) are given in U.S. Pat. Nos. 3,287,125, 3,329,034 and 3,287,124. The particularly desirable exemplified compounds include Compounds (A-1) through (A-39) given in Japanese Patent O.P.I. Publication No. 4-86741, pp.10. Of compounds represented by Formula (A) the compound represented by the following Formula (II) is preferable in that the effects of the invention are markedly displayed.

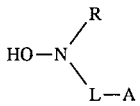

Formula (II)

In Formula (II), R represents a hydrogen atom or an alkyl group; A represents a carboxyl group, a sulfo group, a phosphono group, a phosphinic acid group, a hydroxyl group, an amino group, an ammonio group, a carbamoyl group or a sulfamoyl group; and L represents an alkylene group.

The compound represented by Formula (II) will be detailed below.

L represents an alkylene group having 1 to 10 carbon atoms and of which the straight-chain or branched-chain is substitutable and, among them, those having 1 to 5 carbon atoms are preferred. To be more concrete, the preferable examples thereof include a methylene group, an ethylene group, a trimethylene group and a propylene group. As for the substituents thereof include, for example, a carboxy group, a sulfo group, a phosphono group, a phosphinic acid residual group, a hydroxy group, an alkyl-substitutable ammonio group and, among them, the preferable examples thereof include a carboxy group, a sulfo group, a phosphono group and a hydroxy group; A represents a carboxy group, a sulfo group, a phosphono group, a phosphinic acid residual group, a hydroxy group, an alkyl-substitutable amino group, an alkyl-substitutable ammonio group (preferably having 1 to 5 carbon atoms), an alkyl-substitutable carbamoyl group (preferably having 1 to 5 carbon atoms) or an alkyl-substitutable sulfamoyl group (preferably having 1 to 5 carbon atoms) and, among them, the preferable examples thereof include c carboxy group, a sulfo group, a hydroxy group, a phosphono group and an alkyl-substitutable carbamoyl group. The examples of -L-A include, preferably, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group and, among them, the particularly preferable examples thereof include a carboxymethyl group, a carboxyethyl group, a sulfoethyl group, a sulfopropyl group, a phosphonomethyl group and a phosphonoethyl group; and R represents a hydrogen atom, an alkyl group having 1 to 10 carbon atoms and of which the straight-chain or the branched-chain is substitutable and, among them, those having 1 to 5 carbon atoms are preferred. The substituents thereof include, for example, a carboxy group, a sulfo group, a phosphono group, a sulfinic acid residual group, a hydroxy group, an alkyl-substitutable amino group, an alkyl-substitutable ammonio group, an alkyl-substitutable carbamoyl group, an alkyl-substitutable sulfamoyl group, a substitutable alkylsulfonyl group, an acylamino group, an alkylsulfonylamino group, an arylsulfonylamino group, an alkoxycarbonyl group, an alkyl-substitutable amino group, an arylsulfonyl group, a nitro group, a cyano group and a halogen atom, provided that there may be two or more substituents. The preferable examples thereof represented by R include a hydrogen atom, a methyl group, an ethyl group, a propyl group, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group and, among them, the particularly preferable examples thereof include a hydrogen atom, a carboxymethyl group, a carboxyethyl group, a sulfoethyl group, a sulfopropyl group, a phosphonomethyl group and a phosphonoethyl group, provided that L and R may also be coupled to each other so as to form a ring.

Next, among the compounds represented by Formula (II), some typical examples thereof will be given below. However, the invention shall not be limited to the compounds given below.

D-(1)

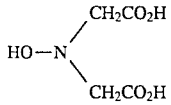

(2)

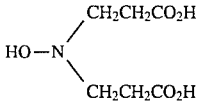

(3)

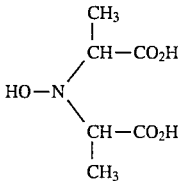

(4)

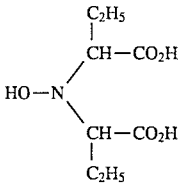

-continued (5)

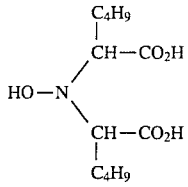

(6)

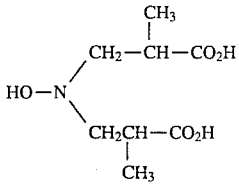

(7)

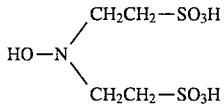

(8)

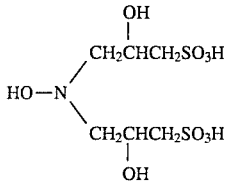

(9)

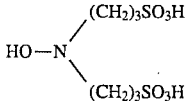

(10)

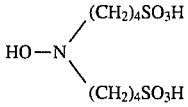

(11)

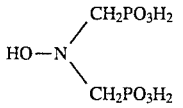

(12)

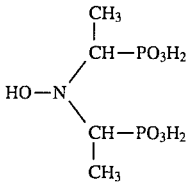

(13)

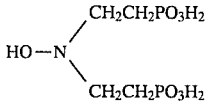

(14)

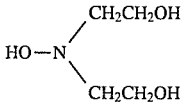

(15)

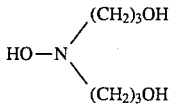

-continued
(16)
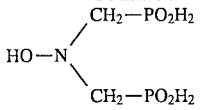
(17)
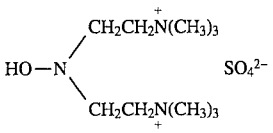
(18)
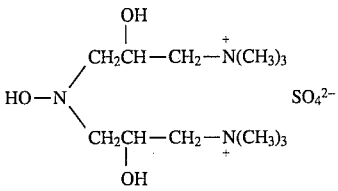
(19) $HO-NH-CH_2CO_2H$
(20) $HO-NH-CH_2CH_2CO_2H$
(21) $HO-NH-CH(CH_3)-CO_2H$
(22) $HO-NH-CH(C_2H_5)-CO_2H$
(23) $HO-NH-CH(C_4H_9)-CO_2H$
(24) $HO-NH-CH(CH_3)-CH_2-CO_2H$
(25) $HO-NH-CH_2-CH(CH_3)-CO_2H$
(26) $HO-NH-CH_2CH_2SO_3H$
(27) $HO-NH-CH_2CH(OH)CH_2SO_3H$
(28) $HO-NH-(CH_2)_3SO_3H$
(29) $HO-NH-(CH_2)_4SO_3H$
(30) $HO-NH-CH_2PO_3H_2$
(31) $HO-NH-CH(CH_3)-PO_3H_2$
(32) $HO-NH-CH_2CH_2PO_3H_2$
(33) $HO-NH-CH_2CH_2OH$
(34) $HO-NH-(CH_2)_3OH$
(35) $HO-NH-CH_2-PO_3H_2$
(36)
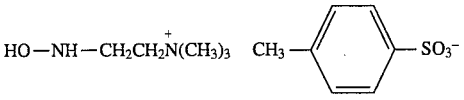
(37)
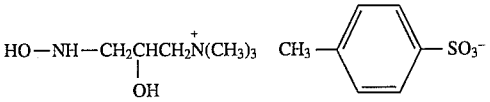
(38)
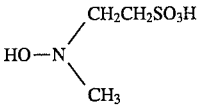
-continued
(39)
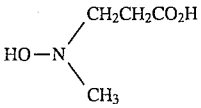
(40)
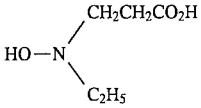
(41)
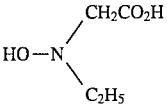
(42)
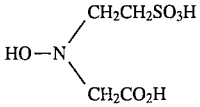
(43)
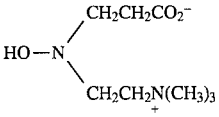
(44)
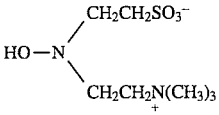
(45)
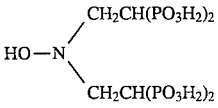
(46) $HONHCH_2CH(PO_3H_2)_2$
(47)
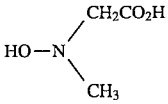
(48)
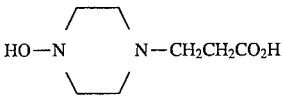
(49)
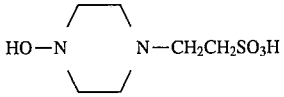
(50)
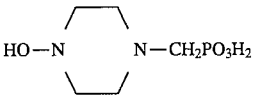
(51)
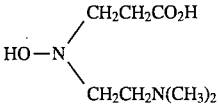
(52)
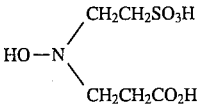

-continued

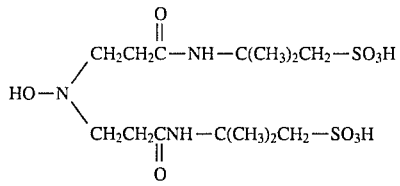

(53)

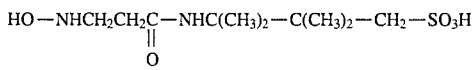

(54)

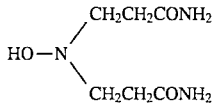

(55)

The typical examples of the compounds represented by the foregoing general Formula (B) include (B-1) through (B-33) given in JP O.P.I Publication No. 486741, pp.11–12, and Compounds (1) through (56) given in JP OPI Publication No. 3- 33846, pp.4~6.

The compounds represented by Formula (A) or (B) are generally used in the form of a free amine, a hydrochloride, a sulfate, a p-toluene sulfonate, an oxalate, a phosphate or an acetate.

In the solid color developing composition used in the invention a slight amount of a sulfite salt can be used as a preservative, and further a buffering agent can be used. The Example of such a sulfite salt includes sodium sulfite, potassium sulfite, sodium bisulfite and potassium bisulfite.

The color developing composition used in the invention preferably contains a buffer. Examples of buffers include potassium carbonate, sodium carbonate, sodium bicarbonate, potassium bicarbonate, trisodium phosphate, tripotassium phosphate, dipotassium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

done, a hydrazine, a mesoionic type compound, an ionic type compound and an imidazole. They may be so added as to meet the requirements.

It is preferable that the solid color developing composition of the invention or a color developer does not substantially contain benzyl alcohol.

For the purposes of preventing a fog production and so forth, chlorine ion and bromine ion may also be applied to a color developer. When these ions are added directly into a color developer, the chlorine ion supplying materials include sodium chloride, potassium chloride, ammonium chloride, nickel chloride, magnesium chloride, manganese chloride and calcium chloride. Among these materials, sodium chloride and potassium chloride may be preferred. The bromine ion supplying materials include sodium bromide, potassium bromide, ammonium bromide, lithium bromide, calcium bromide, magnesium bromide, manganese bromide, nickel bromide, cerium bromide and thallium bromide. Among these materials, potassium bromide and sodium bromide may be preferred. They may also be supplied in the form of the counter salts of a fluorescent whitening agent which is to be added into a color developer.

If required, the color, developers of the invention are allowed to be further added with any desired antifoggant, in addition to the chloride ion and bromide ion. The antifoggant applicable thereto include an alkali-metal halide such as potassium iodide and an organic antifoggant. The organic antifoggants may be typified by nitrogen-containing heterocyclic compounds including, for example, benzotriazole, 6-nitrobenzoimidazole, 5-nitroisoindazole, 5-methylbenzotriazole, 5-nitrobenzotriazole, 5-chlorobenzotriazole, 2-thiazolylbenzo imidazole, 2-thiazolylmethylbenzoimidazole, indazole, hydroxyazaindolidine and adenine.

From the viewpoint of displaying the effect of the invention, it is preferable that the solid color developing composition of the invention or a color developing composition of the invention contains a triazinyl stilbene type fluorescent whitening agent. Such a fluorescent whitening agent as mentioned above includes, preferably, a compound represented by the following Formula [E].

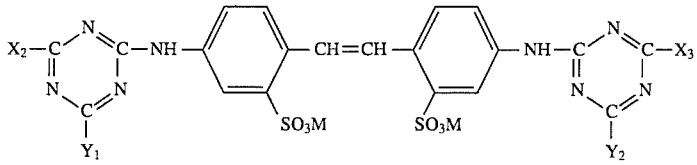

Formula [E]

The development accelerators include, for example; thioether type compounds typified by those given in JP Examined Publication Nos. 37-16088/1962, 37-5987/1962, 38-7826/1963, 44-12380/1969 and 45-9019/1970 and U.S. Pat. No. 3,813,247; p-phenylene diamine type compounds typified by those given in JP OPI Publication Nos. 52-49829/1977 and 50- 15554/1975; quaternary ammonium salts typified by those given in JP Examined Publication No. 44-30074/1969 and JP OPI Publication Nos. 50-137726/1975, 56-156826/1981 and 52- 43429/1977; p-aminophenols given in U.S. Pat. Nos. 2,610,122 and 4,119,462; amine type compounds given in U.S. Pat. Nos. 2,494,903, 3,128,182, 4,230,796 and 3,253,919, JP Examined Publication No. 41-11431/1966 and U.S. Pat. Nos. 2,482,546, 2,596,926 and 3,582,346; polyalkylene oxides typified by those given in JP Examined Publication Nos. 37-16088/1962 and 42- 25201/1967, U.S. Pat. No. 3,128,183, JP Examined Publication Nos. 41-11431/1966 and 42-23883/1967 and U.S. Pat. No. 3,532,501; and, besides the above, a 1-phenyl-3-pyrazotiwherein $X_2$, $X_3$, $Y_1$ and $Y_2$ independently represent a hydroxyl group or a halogen atom such as chlorine or bromine, an alkyl group, an aryl group,

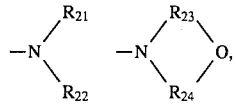

or $OR_{25}$, in which $R_{21}$ and $R_{22}$ independently represent a hydrogen atom, an alkyl group (including a substituent thereof) or an aryl group (including a substituent thereof), $R_{23}$ and $R_{24}$ independently represent an alkylene group (including a substituent thereof), $R_{25}$ represents a hydrogen atom, an alkyl group (including a substituent thereof) or an aryl group (including a substituent thereof), and M represents a cation. The groups in Formula [E] and the substituents thereof are each synonymous with those described in Japanese Patent O.P.I. Publication No. 4-118649/1990, paragraphs [0159] through [0164]. These compounds are prepared by the conventional synthetic method. Among them, E-4, E-24, E-34, E-35, E-36, E-37 and E-41 may preferably be used.

To the color developing composition of the invention, methyl cellosolve, methanol, acetone, dimethyl formamide, β-cyclodextrin and, besides, the compounds given in JP Examined Publication Nos. 47-33378/1972 and 44-9509/1969 may be added for improving the solubility of a color developing agent.

Besides the above, a variety of additives such as an antistaining agent, an antisludging agent and an interlayer-effect accelerating agent may also be used therein.

From the viewpoint of effectively achieving the objects of the invention, the color developer preferably contains the chelating agent represented by the following Formula (K) and the exemplified compounds K-1 through K-22 given in Japanese Patent O.P.I. Publication No. 4-118649, p.19 to p.20.

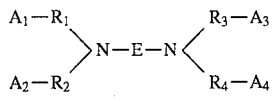

Formula (K)

In Formula (K) E represents a substituted or unsubstituted alkylene, cycloalkylene, phenylene group, $—R_5OR_5—$, $—R_5OR_5OR_5—$ or $—R_5ZR_5—$, Z representing $>N—R_5—A_5—$ or $>N—A_5—$, wherein $R_1$ through $R_5$ independently represent a substituted or unsubstituted alkylene group and $A_1$ through $A_5$ independently represent a hydrogen atom, —OH, —COOM, or $—PO_3(M)_2$ wherein M represents a hydrogen atom or an alkali metal atom.

Exemplified chelating compound

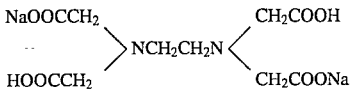

K-1

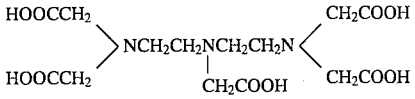

K-2

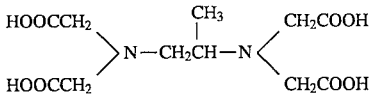

K-3

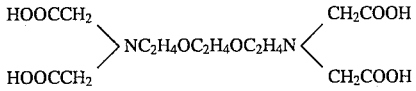

K-4

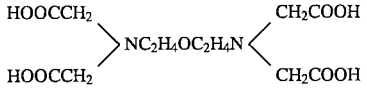

K-5

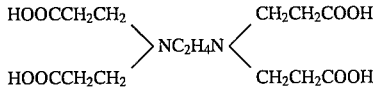

K-6

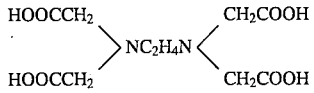

K-7

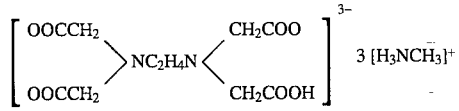

K-8

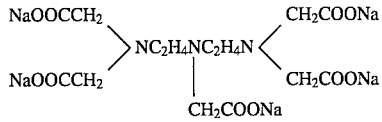

K-9

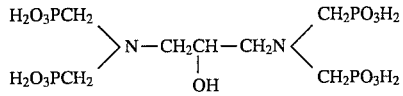

K-10

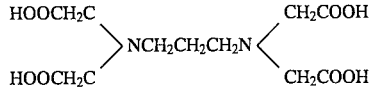

K-11

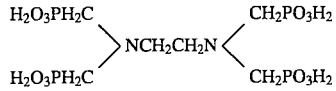

K-12

-continued
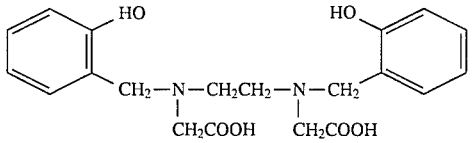
K-13
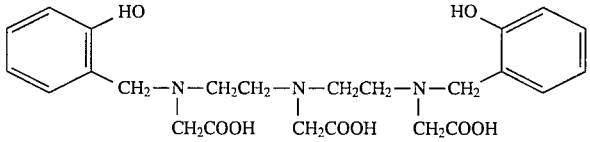
K-14
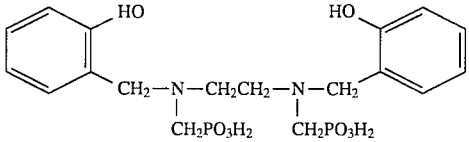
K-15
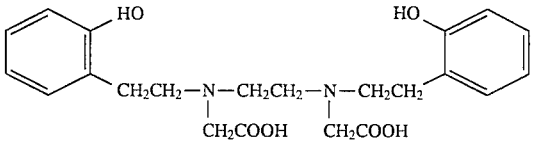
K-16
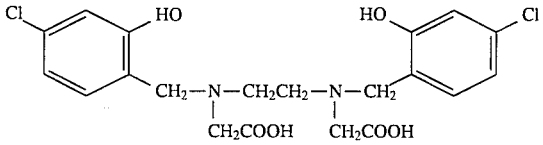
K-17
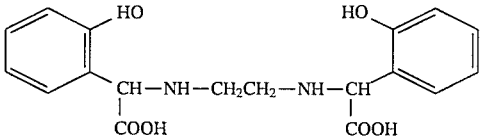
K-18
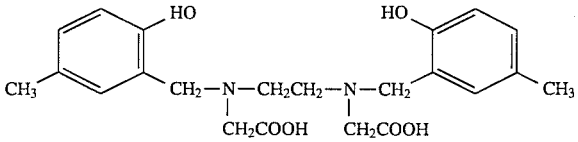
K-19
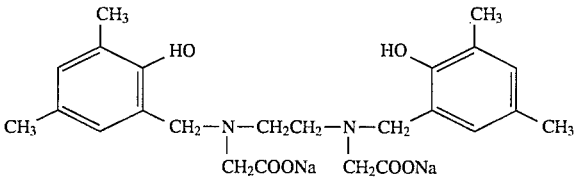
K-20
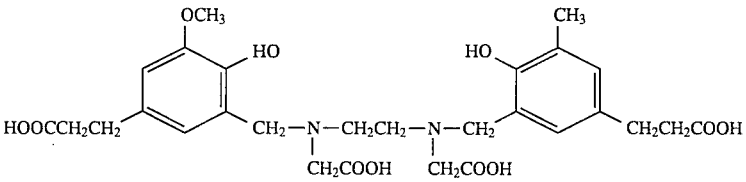
K-21
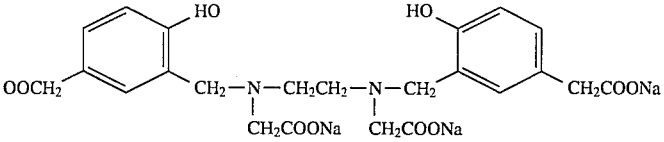
K-22
Among the above-given chelating agents, K-2, K-9, K-12, K-13, K-17 and K-19 may preferably be used. In particular, K- 2 and K-9 markedly displays the effect of the invention.
The above color developing composition is also allowed to contain such a surfactant as an anionic, cationic, amphoteric or nonionic surfactant. Further, the developing composition may optionally contain such a surfactant as an alkylsulfonic acid, arylsulfonic acid, aliphatic carboxylic acid or aromatic carboxylic acid.

The p-phenylenediamine color developing agent content of the solution is preferably 0.011 to 0.066 mol/l from the viewpoint of remarkably exhibiting the effects of the invention, more preferably 0.016 to 0.062 mol/l, and still more preferably 0.018 to 0.062 mol/l. In Examples described later the p-phenylenediamine color developing agent content was not less than 0.018 mol/l when the samples of the invention were processed in a color developing time of 22 seconds, and the content was not less than 0.022 mol/l particularly in sample Nos. 1–11 through 1–18.

In the invention the temperature of the processing solution in the color developing tank is controlled to be preferably within the range predetermined, and more preferably within the range of ±1.5° C. (especially ±0.5° C.).

The photosensitive material used in the invention is preferably one described in paragraphs [0061]–[0082] of Japanese Patent O.P.I. Publication No. 6-35130, and a silver halide color photosensitive material comprising a silver halide emulsion containing silver halide grains having not less than 80 mol % of silver chloride is more preferably in that the effects of the invention are markedly displayed.

EXAMPLES

Next, the present invention will be explained below, and is not limited thereto.

Example 1

An automatic developing apparatus (hereinafter refers to an automatic processor) to which the present invention can be applied will be explained with reference to the accompanying drawings. The automatic processor used in this Example is one modifying Nice Print System NPS818 SQA produced by Konica Corporation. FIG. 1 is a schematic illustration showing the construction of a photosensitive material processing apparatus (printer processor) in which the automatic developing apparatus A and photographic printer B are integrated.

In FIG. 1, in the left lower portion of the photographic printer B, there is provided a magazine M in which a roll of photographic paper, which is an unexposed silver halide photographic material, is accommodated. The photographic paper is pulled out from the magazine M and conveyed by the feed rollers R1 and cut into a predetermined size by the cutter C. In this way, a sheet of photographic paper can be provided. This sheet of photographic paper is conveyed by the belt conveyance means Be. Then an image of the original O is exposed onto the sheet of photographic paper by a light source and lens L in the exposure section E. The exposed sheet of photographic paper is further conveyed by a plurality of pairs of feed rollers R2, R3 and R4, so that the sheet of photographic paper is introduced into the automatic developing apparatus A. In the automatic developing apparatus A, the sheet of photographic paper is successively conveyed by a roller conveyance means (the reference numeral is not attached to the means) into the color development tank 1A, bleaching and fixing tank 1B and stabilizing tanks 1C, 1D, 1E, wherein these tanks substantially compose a processing tank 1. Due to the foregoing, the sheet of exposed photographic paper is subjected to color development, bleaching and fixing processing and stabilizing processing. After the processing has been completed, the sheet of photographic paper is dried by the drying section 5, and then discharged outside of the apparatus.

In this connection, the one-dotted chain line in the drawing shows a conveyance passage of the silver halide photosensitive material. In this example, the photosensitive material is cut into a sheet and introduced into the automatic developing apparatus A, however, a strip-shaped photosensitive material may be introduced into the automatic developing apparatus A. In this case, the processing efficiency can be enhanced when an accumulator for temporarily stocking the photosensitive material is provided between the automatic developing apparatus A and photographic printer B. Of course, the automatic developing apparatus A of the present invention may be constructed integrally with the photographic printer B, or alternatively the automatic developing apparatus A of the present invention may be constructed separately from the photographic printer B. Of course, the silver halide photosensitive material processed by the automatic developing apparatus A of the present invention is not limited to the exposed photographic paper, but an exposed negative film may be applied to the automatic developing apparatus A of the present invention. The explanation of the present invention is made under the condition that the automatic developing apparatus A includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic developing apparatus having four tanks of a color developing tank, bleaching tank, fixing tank and stabilizing tank. The color development tank 1A, bleaching and fixing tank 11B and stabilizing tanks 1E are respectively provided with the solid processing composition supply devices 3A, 3B and 3E for supplying the solid processing composition.

Figure 2:
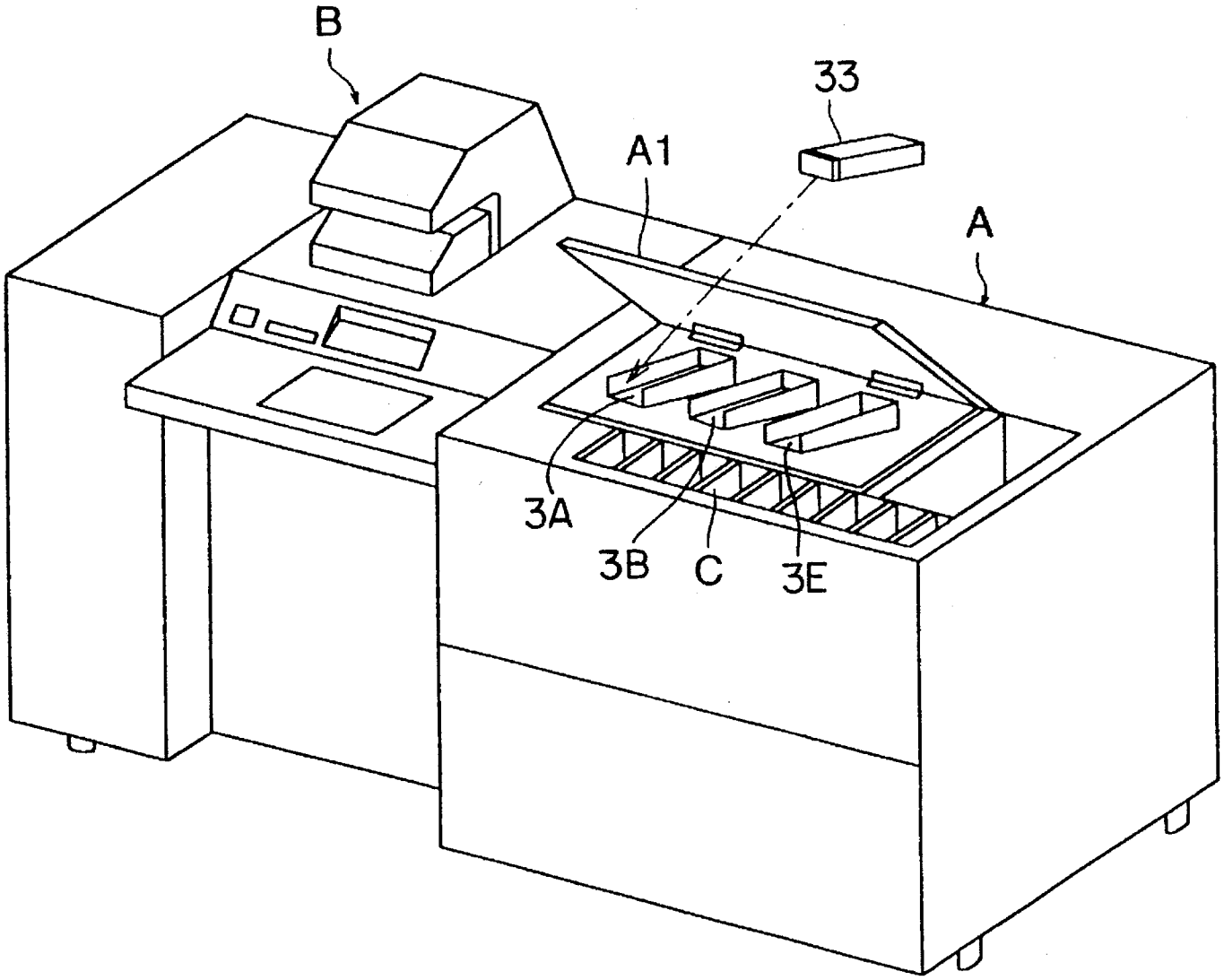
FIG. 2 is a perspective view of the photosensitive material processing apparatus.

FIG. 2 is a perspective view showing the entire photosensitive material processing apparatus in which the automatic developing apparatus A of the present invention, photographic printer B and sorter C are integrally combined. In FIG. 2, the cover A1 of the automatic developing apparatus A is opened upward, and the accommodating container D having solid processing composition is inserted into the accommodating container charging means A2 from the left upper to the right lower position in the drawing. After that, they are fixed.

Figure 3:
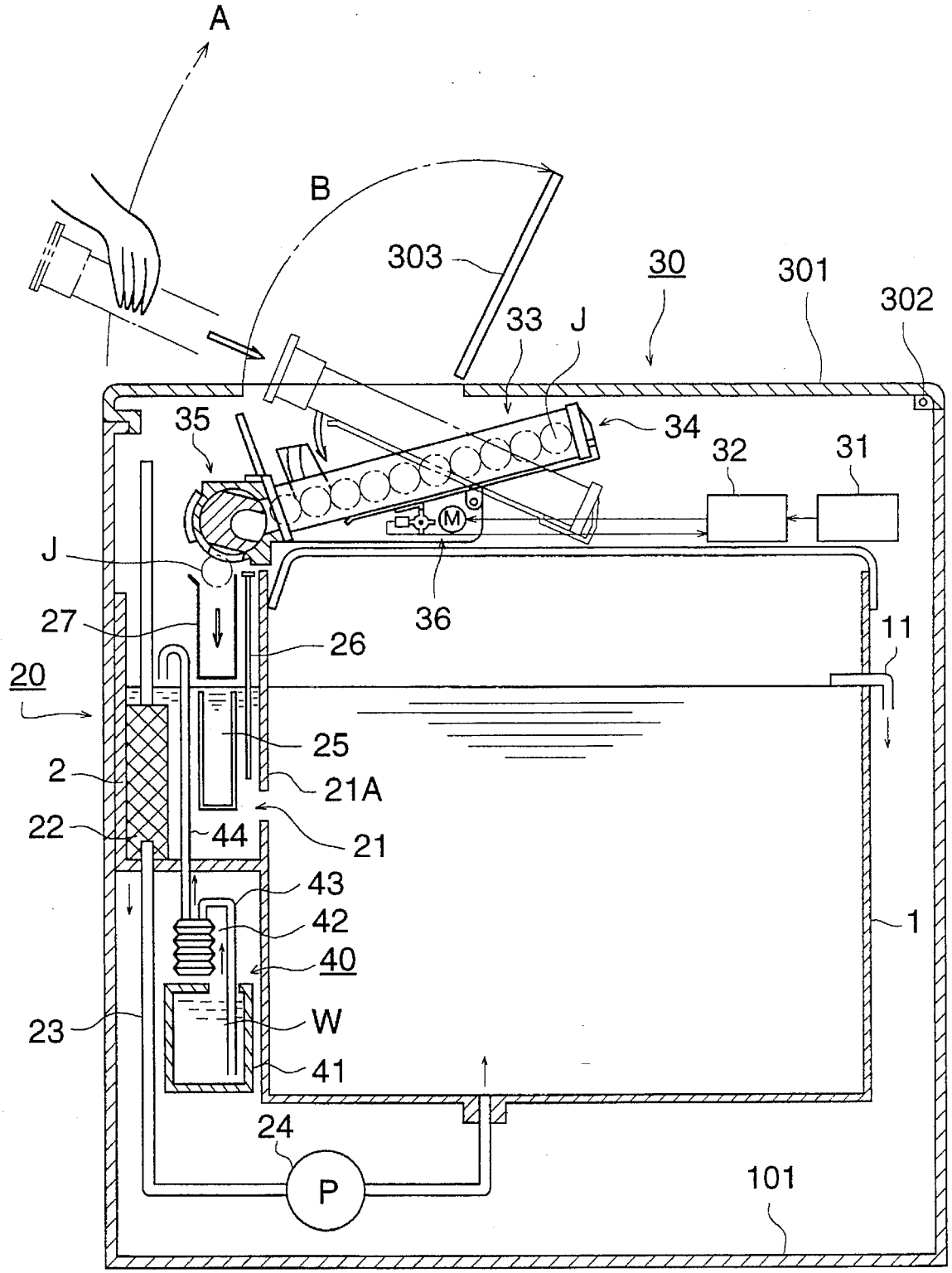
FIG. 3 is a sectional view of the automatic developing apparatus according to the present invention.

FIG. 3 is a sectional view of the processing composition charging section and processing composition supply means of the color development tank A taken on line I—I in FIG. 1. In this case, the construction of the bleaching and fixing tank 1B and that of the stabilizing tank 1E are the same as the construction of the color development tank 1A. Therefore, the explanation of the processing tank 1 can be applied to all tanks of the color development tank 1A, bleaching and fixing tank 1*b*, and stabilizing tank 1E. In this connection, for enhancing the understanding of the invention, the conveyance means for conveying the photosensitive material is omitted in the drawing. In this example, explanations will be made under the condition that tablets of solid processing composition are used.

The processing tank 1 for processing the photosensitive material includes a solid processing composition charging section 20 for supplying tablets of solid processing composition, the solid processing composition charging section 20 being integrally provided outside the separation wall of the processing tank 1, and a constant temperature tank 2. The processing tank 1 and constant temperature tank 2 are separated by a partition wall 21A on which a communicating hole 21 is formed so that the processing solution can be communicated through the communicating hole 21. Since an enclosure 25 for receiving the tablets J of solid processing composition is provided in the solid processing composition charging section 20 disposed at an upper position of the constant temperature tank 2, the tablets J of solid processing composition are not moved to the processing tank 1 in the form of a solid body. In this connection, the enclosure 25 is made of material such as a net or filter so that the processing solution can pass through the enclosure 25, however, the tablet J in the form of a solid body can not pass through the enclosure 25 until it is dissolved.

A cylindrical filter 22 is disposed below the constant temperature tank 2 in such a manner that the cylindrical filter 22 can be replaced. The cylindrical filter 22 removes insoluble substances, for example, precipitations, in the processing solution. A circulation pipe 23 connected with the suction side of a circulation pump 24 (circulation means) is inserted into the filter 22 passing through the lower wall of the constant temperature tank 2.

As shown in FIG. 3, the circulation system includes the circulation pipe 23 forming a circulation passage of the processing solution, and also includes the circulation pump 24 and the processing tank 1. One end of the circulation pipe 23 is communicated with the delivery side of the circulation pump 24, and the other end penetrates a lower wall of the processing tank 1, so that the circulation pipe 23 is communicated with the processing tank 1. Due to the foregoing construction, when the circulation pump 24 is operated, the processing solution is sucked from the constant temperature tank 2 and discharged into the processing tank 1, so that the discharged processing solution is mixed with the processing solution in the processing tank 1, and then sent to the constant temperature tank 2. In this way, the processing solution is circulated. The circulating direction of the processing solution is not limited to the direction shown in FIG. 3, but the direction may be reverse to that shown in FIG. 3.

A waste solution pipe 11 is provided for permitting the processing solution in the processing tank 1 to overflow, so the solution level can be maintained constant and an increase in the components conveyed from other tanks into the processing tank 1 can be prevented. Further, an increase in the components oozing out from the photosensitive material can be prevented.

A rod-shaped heater 26 penetrates an upper wall of the constant temperature tank 2, and is dipped in the processing solution in the constant temperature tank 2. The processing solution in the constant temperature tank 2 and processing tank 1 is heated by this heater 26. In other words, the heater 26 is a temperatures regulating means for regulating the temperature of the processing solution in the processing tank 1, so that the temperatures can be controlled in an appropriate range, for example, in a range from 20° to 55° C.

A input information detecting means 31, for example, a photoelectric sensor, is disposed at an entrance of the automatic developing apparatus A, and detects the amount of the photosensitive material to be processed. This input information detecting means 31 is comprised of a plurality of detecting units that are disposed in a transverse direction of the photosensitive material and detects the width of the photosensitive material, and counts the detection time. Since the conveyance speed of the photosensitive material is previously set mechanically, the throughput of the photosensitive material, that is, the area of processed photosensitive materials can be calculated from the sensed width and time information. An infrared ray sensor, microswitch and ultrasonic sensor capable of detecting the width and conveyance time of photosensitive material can be used for this input information detecting means 31. A means for indirectly detecting the area of the processed photosensitive material may be used for this input information detecting means 31. For example, in the case of the printer processor shown in FIG. 1, a means for detecting an amount of the printed photosensitive material may be adopted, or alternatively, a means for detecting an amount of the processed photosensitive material, the area of which is predetermined, may be adopted. Concerning the detecting time, in this example, detection is carried out before processing, however, detection may be carried out after processing or while the photosensitive material is being dipped in the processing solution. In these cases, the input information detecting means 31 may be disposed at an appropriate position so that detection can be conducted after processing or while the photosensitive material is being processed. It is not necessary to provide the input information detecting means 31 for each processing tank 1A, 1B, 1C, 1D, 1E, and it is preferable that one input information detecting means 31 is provided for any single automatic developing apparatus A. The solid processing composition supply control means 32 controls the supply of the processing composition in the solid processing composition replenishing device 30 and the replenishing water in the water replenishing device 40 in accordance with a signal sent from the input information detecting means 31.

The solid processing composition replenishing device 30 used for the photosensitive material processing apparatus of the present invention is disposed above the photosensitive material processing apparatus, and comprises an accommodating container 33, accommodating container charging means 34, supply means 35 and drive means 36, wherein the solid processing composition replenishing device 30 is tightly closed by an upper cover 301. The upper cover 301 is rotatably connected with a main body 101 accommodating the processing tank 1 and constant temperature tank 2, through a support shaft 302 attached to the back of the main body. The upper cover 301 is lifted upward as shown by a one-dotted chain line in FIG. 3, so that the front and upper portions of the apparatus can be widely opened. In this way, inspection of the solid processing composition replenishing device 30, and replacement of the filter 22 can be easily conducted. A hatch 303 is hinged to a portion of the upper surface of the upper cover 301. When the hatch 303 is opened as illustrated by the one-dotted chain line B in the drawing, the accommodating container 33 is attached or replaced.

The replenishing water supply means 40 is provided in the neighborhood of the above constant temperature tank in the photosensitive material processing apparatus 101. The replenishing water supply means 40 is comprised of the replenishing water tank 41, a bellows pump 42, a water suction pipe 43 and a water delivery pump 44. The replenishing water W in the replenishing water tank 41 is pumped through the pipe 43 by the bellows pump 42 and supplied through the water delivery pump 44 to the surface of the processing solution in the processing tank 2 by the bellows pump 42 and then sent to the constant temperature tank 2. The water is intermittently supplied by the bellows pump 42 whose motor is controlled and driven by a replenishing water supply controlling means.

The solid processing composition for a color paper was prepared as follows.

(1) Preparation of the solid processing composition for a color developer of a color paper Procedure (1)

In a bandamu-mill available on the market 1350.0 g of a color developing agent CD-3 (4-amino-3-methyl-N-ethyl-N-β-methanesulfonamidoethyl-aniline sulfate) was pulverized up to have an average particle size of 10 μm. The resulting fine particles were mixed with 1000.0 g of polyethylene glycol having an weight average molecular weight of 6000 in a mixer available on the market and then were granulated for 7 minutes in a stirring granulator available on the market by adding 50 ml of water thereto. Thereafter, the resulting granules were dried at 40° C. for 2 hours in a fluid-bed type drier available on the market to completely remove the moisture.

Procedure (2)

In the same manner as in Procedure (1) 400.0 g of bis(sulfoethyl)hydroxylamine disodium salt, 1700.0 g of sodium p-toluenesulfonate and 300.0 g of Tinopar SFP (produced by Ciba-Geigy Co.) were pulverized, and mixed with 240.0 g of Pineflow (produced by Matsutani Kagaku Co). Next, the mixture was granulated in the same manner as in Procedure (1) by adding 60.0 ml of water thereto. Thereafter, the granules were dried at 50° C. for 2 hours to completely remove the moisture.

Procedure (3)

In the same manner as in Procedure (1) 330.0 g of pentasodium diethylenetriamine pentaacetate, 130.0 g of sodium p-toluenesulfonate, 37.0 g of sodium sulfite, 340.0 g of lithium hydroxide and 3300.0 g of anhydrous potassium carbonate were pulverized and uniformly mixed with 500.0 g of polyethylene glycol having an weight average molecular weight of 4000 and 600 g of mannitol at not more than 40% RH in a mixer available on the market. Next, the mixture was granulated in the same manner as in Procedure (1) by adding 800 ml of water thereto. Thereafter, the granules were dried at 60° C. for 30 minutes to completely remove the moisture.

Procedure (4)

The above obtained granules in Procedures (1) to (3) were mixed for 10 minutes through a cross rotary mixer available on the market and then mixed with 50.0 g of N-myristoylalanine sodium salt in a mixer available on the market. This refers to sample type-1. Thereafter, the resulting mixture granules were continuously tableted at a tableting pressure of 7 t making use of a rotary tableting machine (Clean Press Correct H18 manufactured by Kikusui Mfg. Works) to obtain a tablet having a diameter of 30 mm, a thickness of 10 mm and a weight of 10.2 g/tablet. Thus, tablet samples for color developing replenisher for a color paper were obtained. This refers to sample type-2.

(2) Preparation of the solid processing composition for bleach-fixer of a color paper Procedure (5)

In the same manner as in Procedure (1) 500.0 g of sodium carbonate monohydrate, 6000.0 g of ammonium ferric ethylenediaminetetraacetate trihydrate and 300.0 g of ethylenediaminetetraacetic acid were pulverized to have an average particle size of 10 μm. The resulting fine particles were mixed in the same manner as in Procedure (1). The mixture was granulated in the same manner as in Procedure (1) by adding 200 ml of water thereto. Thereafter, the granules were dried at 60° C. for 3 hours to completely remove the moisture.

Procedure (6)

In the same manner as in Procedure (13) 8000.0 g of ammonium thiosulfate and 3050.0 g of sodium metabisulfite were pulverized in the same manner as in Procedure (1) and 500 g of Pineflow (produced by Matsutani Kagaku Co.) was added thereto and mixed. The mixture was granulated in the same manner as in Procedure (1) by adding 170 ml of water thereto. Thereafter, the granules were dried at 60° C. for 2 hours to completely remove the moisture.

Procedure (7)

The above obtained granules in the above Procedures (5) and (6) was mixed in the same manner as in Procedure (4) and mixed with 1000.0 g of polyethyleneglycol having an weight average molecular weight of 4000 and 97.0 g of N-lauroylsarcosine sodium salt at 25° C. and not more than 40% RH in a mixer. This refers to sample type-1. Thereafter, the resulting mixture granules were continuously tableted making use of a rotary tableting machine (Tough Press Correct H18 manufactured by Kikusui Mfg. Works) to obtain tablet samples for bleach-fixer of a color paper having a diameter of 30 mm and a weight of 11 g. These are designated to be sample type 2.

(3) Preparation of the solid processing composition for stabilizer of a color paper Procedure (8)

In the same manner as in Procedure (1) 450.0 g of sodium carbonate monohydrate, 3000.0 g of trisodium 1-hydroxyethane-1,1'-diphosphonate, 150.0 g of disodium ethylenediaminetetraacetate and 70.0 g of o-phenylphenol were pulverized and 500.0 g of polyethyleneglycol having an weight average molecular weight of 6000 was added thereto and mixed. The mixture was granulated in the same manner as in Procedure (1) by adding 60 ml of water thereto. Thereafter, the granules were dried at 70° C. for 2 hours to completely remove the moisture. To the thus obtained granules are added 30.0 g of N-lauroylsarcosine sodium salt and mixed for 3 minutes through a mixer in a room of 25° C. and not more than 40% RH. This refers to sample type-1. Thereafter, the resulting mixture granules were tableted making use of a rotary tableting machine (Tough Press Correct H18 manufactured by Kikusui Mfg. Works) to obtain tablet samples for stabilizer of a color paper having a diameter of 30 mm and a weight of 10.5 g. This refers to sample type-2.

A light-sensitive material having 99.5 mol % of silver chloride content as described in Example 1 of Japanese Patent O.P.I. Publication No. 4-264550 was exposed according to the conventional method and processed employing the above obtained tablets (sample type 2) according to the following process.

In this process was used an automatic processor Nice Print System NPS818 SQA produced by Konica corporation, which was modified to have the structure as illustrated in FIGS. 1 through 3.

| Process | Temperature (°C.) | Processing time (sec.) | Replenishing amount of tablets | Replenishing amount of water |
|---|---|---|---|---|
| Color Development | 40.0 ± 0.5 | see Table 1 | see Table 1 | see Table 1 |
| Bleach-Fixing | 35.0 ± 1.0 | 22 | 6.2 g/m$^2$ | 80 ml/m$^2$ |
| Stabilizing | | | | |
| 1 | 33.0 ± 3.0 | 22 | — | — |
| 2 | 33.0 ± 3.0 | 22 | — | — |
| 3 | 33.0 ± 3.0 | 22 | 1.0 g/m$^2$ | 247 ml/m$^2$ |
| Drying | 72.0 ± 5.0 | 50 | — | — |

The stabilizing is a back flow method overflowing from stabilizing 3 to 1, wherein 80 ml/m$^2$ of the overfow of stabilizing 1 was introduced as a replenishing water into the bleach-fix tank. Tablets was placed in the tablet supply device provided in the automatic developing apparatus and the charging interval of the tablets was adjusted so that the charging amount of the tablets was that shown as above. The charging amount per time was two tablets (21.0 g) in the case of color developer, two tablets (22.0 g) in the case of bleach-fix and one tablet (10.5 g) in the case of stabilizer. The replenishing water was also adjusted in accordance with the above treatment. As the initial processing solution in each tank was employed the following solution prepared as described below (replenishing method 1).

[Color developer] The amount refers to the amount per liter of the developer.

| | |
|---|---|
| Sodium sulfite | 0.05 g |
| Pentasodium diethylenetriamine pentaacetate | 3.0 g |
| Polyethyleneglycol having an weight average molecular weight of 4000 | 10.0 g |
| Bis(sulfoethyl)hydroxylamine disodium salt | 4.0 g |
| Tinopar SFP (produced by Ciba-Geigy Co.) | 1.0 g |
| Sodium p-toluenesulfonate | 30.0 g |
| Mannitol | 6.0 g |
| Potassium chloride | 4.0 g |
| Pineflow | 3.0 g |
| Color developing agent (4-amino-3-methyl-N-ethyl-N-β-methanesulfonamidoethyl-aniline sulfate) CD-3 | 8.0 g |
| Potassium carbonate | 33.0 g |
| Lithium hydroxide | 3.5 g |
| Sodium N-myristoylalanine | 0.30 |
| Adjusted to be pH 10.00 ± 0.05 using potassium hydroxide or sulfuric acid. | |

[Bleach-fixer] The amount refers to the amount per liter of the developer.

| | |
|---|---|
| Sodium ferric ethylenediaminetetraacetate monohydrate | 60.0 |
| Ethylenediaminetetraacetic acid | 6.7 g |
| Ammonium thiosulfate | 72.0 g |
| Sodium thiosulfate | 8.0 g |
| Sodium metabisulfite | 7.5 g |
| Adjusted to be pH 6.0 ± 0.05 using potassium carbonate or maleic acid. | |

[Stabilizer] The amount refers to the amount per liter of the developer.

| | |
|---|---|
| Trisodium 1-hydroxyethylidene-1,1-diphosphonate | 3.0 |
| Disodium ethylenediaminetetraacetate | 1.5 g |
| Sodium carbonate | 0.5 g |
| 0-Phenylphenol | 0.08 g |
| Adjusted to be pH 8.0 ± 0.05 using sodium carbonate or sulfuric acid. | |

The same treatment as above was conducted for comparison, except for using a replenishing solution prepared from the replenishing amounts of the tablets and water as shown in the above and the automatic developing apparatus Nice Print System NPS SQA (produced by Konica Corporation) which employs the conventional replenishing method and is not modified to the structure as shown in FIG. 1.

The replenishing amount of each solution was adjusted to be the sum of the replenishing amounts of the tablets and water as shown in the above process (replenishing method 2).

In either replenishing method water corresponding to the evaporated water was added to each tank and running processing was conducted. In the running processing 7.5 $m^2$ of the color paper per day were continuously processed and 450 $m^2$ of the color paper in total were processed.

After the running process, the color paper sample was wedge exposed according to the conventional method and processed. The minimum reflection blue density Dmin(Y) and the maximum reflection blue density Dmax(Y) of the resulting sample were measured using X-rite (produced by Nihon Heihankizai Co.).

The appearance in the color development tank during the running process and the appearance of the color development replenisher tank in the replenishing method 2 (the conventional one) were observed and evaluated according to the following criterions.

(Deposits)

—: no problem since no replenishing tank is present.

○: no problem and no deposits produce.

Δ: Slight deposits produce on the wall of the tank and on the rack.

X : Deposits produce in the whole of the tank.

(Precipitations)

—: no problem since noreplenishing tank is present.

○: no problem and no precipitations produce.

Δ: Precipitations produce temporarily.

X : Precipitations produce constantly and there occur problems in the circulation system.

(Falling of the surface of the processing solution)

○: no problem.

X : The surface continues to fall if water is not replenished.

TABLE 1

| Sample No. | Replenishing method | Color developing time (sec.) | Charging amount of the solid processing composition ($g/m^2$) | Charging amount of the replenishing water ($l/m^2$) | Charging amount of CD-3/Charging amount of the replenishing water (mol/l) | Dmin (Y) | Dmax (Y) | Appearance of the color development replenisher tank: Deposits | Appearance of the color development replenisher tank: Precipitations | Appearance of the color development tank: Deposits | Appearance of the color development tank: Precipitations | Appearance of the color development tank: Fall of the solution surface |
|---|---|---|---|---|---|---|---|---|---|---|---|---|
| 1-1 (Comp.) | (2) | 45 | 6.0 | 0.077 | 0.023 | 0.08 | 2.26 | Δ | Δ | ○ | ○ | ○ |
| 1-2 (Comp.) | (2) | 45 | 6.0 | 0.075 | 0.024 | 0.16 | 2.06 | X | Δ | X | Δ | ○ |
| 1-3 (Inv.) | (1) | 45 | 6.0 | 0.075 | 0.024 | 0.07 | 2.21 | — | — | ○ | ○ | ○ |
| 1-4 (Inv.) | (1) | 45 | 5.5 | 0.060 | 0.027 | 0.05 | 2.21 | — | — | ○ | ○ | ○ |
| 1-5 (Inv.) | (1) | 45 | 5.6 | 0.060 | 0.028 | 0.05 | 2.30 | — | — | ○ | ○ | ○ |
| 1-6 (Comp.) | (2) | 22 | 8.4 | 0.075 | 0.033 | 0.21 | 1.58 | X | X | X | X | ○ |

TABLE 1-continued

| Sample No. | Replenishing method | Color developing time (sec.) | Charging amount of the solid processing composition (g/m²) | Charging amount of the replenishing water (l/m²) | Charging amount of CD-3/Charging amount of the replenishing water (mol/l) | Dmin (Y) | Dmax (Y) | Appearance of the color development replenisher tank: Deposits | Appearance of the color development replenisher tank: Precipitations | Appearance of the color development tank: Deposits | Appearance of the color development tank: Precipitations | Appearance of the color development tank: Fall of the solution surface |
|---|---|---|---|---|---|---|---|---|---|---|---|---|
| 1-7 (Inv.) | (1) | 22 | 8.4 | 0.075 | 0.033 | 0.06 | 2.29 | — | — | ○ | ○ | ○ |
| 1-8 (Inv.) | (1) | 22 | 8.1 | 0.070 | 0.034 | 0.05 | 2.30 | — | — | ○ | ○ | ○ |
| 1-9 (Inv.) | (1) | 22 | 7.5 | 0.060 | 0.037 | 0.06 | 2.30 | — | — | ○ | ○ | ○ |
| 1-10 (Inv.) | (1) | 22 | 7.0 | 0.050 | 0.042 | 0.05 | 2.29 | — | — | ○ | ○ | ○ |
| 1-11 (Inv.) | (1) | 22 | 6.4 | 0.040 | 0.048 | 0.06 | 2.29 | — | — | ○ | ○ | ○ |
| 1-12 (Inv.) | (1) | 22 | 6.1 | 0.035 | 0.052 | 0.10 | 2.29 | — | — | Δ | ○ | ○ |
| 1-13 (Inv.) | (1) | 22 | 5.8 | 0.030 | 0.058 | 0.11 | 2.30 | — | — | Δ | ○ | ○ |
| 1-14 (Comp.) | (1) | 22 | 5.5 | 0.025 | 0.066 | 0.18 | 2.17 | — | — | X | ○ | X |
| 1-15 (Comp.) | (1) | 45 | 5.0 | 0.025 | 0.060 | 0.11 | 2.26 | — | — | Δ | ○ | X |
| 1-16 (Inv.) | (1) | 22 | 6.2 | 0.030 | 0.062 | 0.12 | 2.28 | — | — | Δ | ○ | ○ |
| 1-17 (Inv.) | (1) | 22 | 6.6 | 0.030 | 0.066 | 0.16 | 2.26 | — | — | Δ | Δ | ○ |
| 1-18 (Comp.) | (1) | 22 | 7.0 | 0.030 | 0.070 | 0.22 | 2.19 | — | — | X | X | ○ |

Inv.: Invention, Comp.: Comparative
In the Comparative Samples of Table 1 were replenished the solutions obtained by dissolving the solid processing composition in the water.

As is apparent from Table 1, the developing method of the present invention gives optimum photographic properties and does not cause problems in the automatic processor. Further, the present invention have attained reduction of waste that the conventional replenishing method could not.

Further, in the same manner as in the above running processing were processed 3.0 m² per day of color paper, Konica Color QA paper type A6 (produced by Konica Corporation). The results Were the same as those of Table 1.

After the running processing the concentration of CD-3 in the processing solution of the color developing tank was 0.010 mol/liter in sample No. 1–3, 0.010 mol/liter in sample No. 1- 4, 0.016 mol/liter in sample No. 1–7 and 0.016 mol/liter in sample Nos. 1–8 through 1–18. As is apparent from the above, the concentration not less than 0.011 mol/liter shows improved photographic properties and the concentration not less than 0.016 mol/liter shows sufficient photographic properties even in reduced processing time.

As is apparent from Table 1, even the local concentration of the above CD-3 in the color developing solution is preferably 0.066 mol/liter in view of deposits and precipitations, and the concentration as a whole of the above CD-3 in the color developing solution is also preferably 0.066 mol/liter. The concentration of the above CD-3 in the color developing solution is more preferably 0.062 mol/liter in view of precipitations.

Even if the deposits or precipitations appear, the amount thereof is reduced as far as the temperature of the solution in the solid processing composition charging device is substantially the same as that in the processing tank or the processing solution is circulated from the processing tank to the solid processing composition charging device. Further, since the filter is provided in the circulation pipe there are no direct adverse effects on the photographic materials processed even if the deposits or precipitations appear. Particularly when the deposits or precipitations are caused by the solid processing composition, the above problems can be solved by incorporating the composition in the portion before the processing solution is filtered.

As is apparent from Table 1, even the local concentration of the above CD-3 in the color developing solution is preferably 0.066 mol/liter in view of deposits and precipitations, and the concentration as a whole of the above CD-3 in the color developing solution is also preferably 0.066 mol/liter. The concentration of the above CD-3 in the color developing solution is more preferably 0.062 mol/liter in view of precipitations.

Experiments were conducted in the same manner as in the above, except that the compound of Formula (1), (C-15), (C-29) or (C-30) was used instead of CD-3, and the same results as above were obtained.

Further, experiments were conducted in the same manner as in the above, except that the compound of (C-14) was used, and substantially the same results as above were obtained, except that Dmax (Y) was slightly deteriorated.

Example 2

Experiments were conducted according to the replenishing method 1 in the same manner as in Example 1, except that the Exemplified compound of Formula (II) or diethylhydroxylamine oxalate was used in an equimolecular amount instead of bis(sulfoethyl)hydroxylamine disodium salt The evaluation criteria are the same as Example 1. The results are shown in Table 2.

TABLE 2

| Sample No. | Compounds used | Color developing time (sec.) | Charging amount of the solid processing composition ($g/m^2$) | Charging amount of the replenishing water ($l/m^2$) | Charging amount of CD-3/ Charging amount of the replenishing water (mol/l) | Dmin (Y) | Dmax (Y) | Appearance of the color development tank: Deposits | Precipitations | Fall of the solution surface |
|---|---|---|---|---|---|---|---|---|---|---|
| 1 (Inv.) | D-2 | 22 | 7.5 | 0.060 | 0.037 | 0.07 | 2.28 | ○ | ○ | ○ |
| 2 (Inv.) | DEHA | 22 | 7.5 | 0.060 | 0.037 | 0.10 | 2.25 | Δ | ○ | ○ |
| 3 (Inv.) | D-2 | 22 | 6.4 | 0.040 | 0.048 | 0.08 | 2.28 | ○ | ○ | ○ |
| 4 (Inv.) | DEHA | 22 | 6.4 | 0.040 | 0.048 | 0.12 | 2.21 | Δ | Δ | ○ |

As is apparent from Table 2, the effects of the invention of stable and less replenishing processing have been attained by using compounds of the present invention represented by Formula (II).

Next, other examples of the invention will be explained below.

Figure 4:
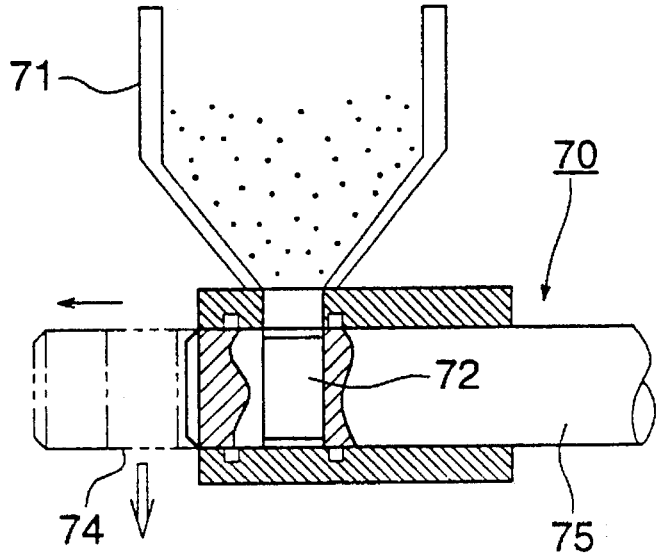
FIG. 4 is a sectional view of the granule processing composition replenishing device.

FIG. 4 is a sectional view of another solid processing composition replenishing device which can be applied to the granule processing composition. The replenishing device 70 having a hopper 71 charged with the granule processing composition supplies a specific amount of the composition to the filter section through a charging section 74, wherein a definite amount of the composition according to the amount of processed photosensitive materials is introduced into a housing member 72 by a piston 75 moving in the horizontal direction to the right and then discharged by the piston 75 moving in the horizontal direction to the left. Experiments were conducted in the same manner as in Example 1, employing this replenishing device, and the modified automatic processor and granules (sample type-1) as described in Example 1. The same results as Example 1 were obtained.

Example 4

Experiments were conducted in the same manner as in Example 2, except that the following replenishing device was used and the same results as Example 2 were obtained.

Figure 5:
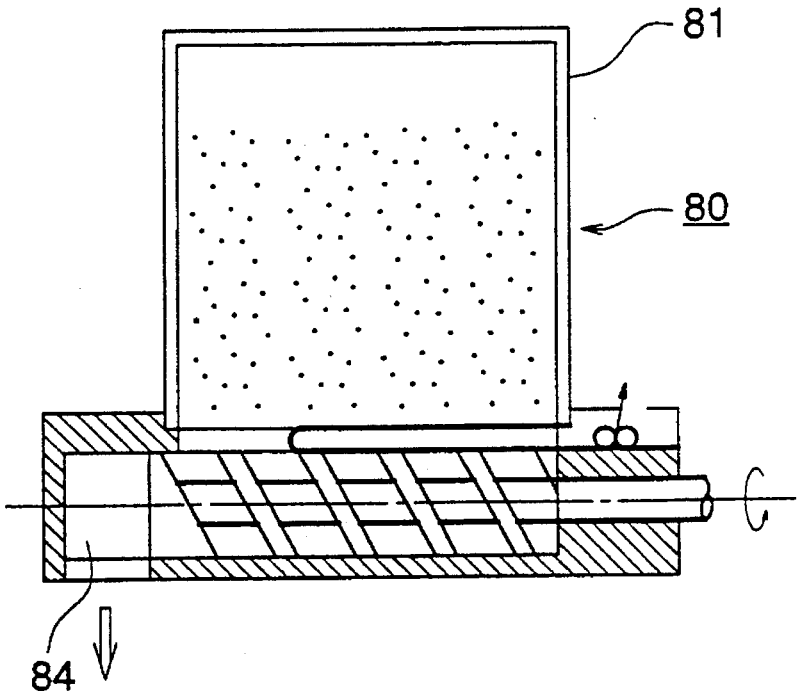
FIG. 5 is a sectional view of another granule processing composition replenishing device.

FIG. 5 is a sectional view of another solid processing composition replenishing device used in this Example. The replenishing device 80 is equipped with a package 81 containing the granule processing composition 85, the automatically opening and closing device actuated by roller 83, and the discharging section 84 in which the granule processing composition is discharged by controlling the rotation rate of the screw 82.

What is claimed is:

1. A method for processing an exposed silver halide color photographic photosensitive material, comprising the step of developing the exposed material with a color developer containing a p-phenylenediamine color developing agent in a color development tank of an automatic developing apparatus, and wherein water and a solid color developing composition comprising a p-phenylenediamine color developing agent having a water-solubilizing group selected from the group consisting of $—(CH_2)_n—CH_2OH$, $—(CH_2)_m—NHSO_2—(CH_2)_n—CH_3$, $—(CH_2)_m—O—(CH_2)_n—CH_3$, $—(CH_2CH_2O)_nC_mH_{2m+1}$ (wherein m and n independently represent an integer of not less than 0), —COOH and $—SO_3H$ are separately added to the color developer to replenish the color developer, wherein the replenishing amount of the water is 30 to 75 ml per $m^2$ of the material processed and the replenishing amount of the color developing agent is 0.024 to 0.066 mol per liter of the replenishing amount of the water.

2. The method of claim 1, wherein the developer comprises the p-phenylenediamine color developing agent in an amount of 0.011 to 0.066 mol per liter.

3. The method of claim 2, wherein the developer comprises the p-phenylenediamine color developing agent in an amount of 0.016 to 0.062 mol per liter.

4. The method of claim 3, wherein the developer comprises the p-phenylenediamine color developing agent in an amount of not less than 0.018 mol per liter.

5. The method of claim 1, wherein the solid color developing composition is in granule, tablet or pellet form.

6. The method of claim 1, wherein the replenishing amount of the solid color developing composition is 0.1 to 50 g per one replenishment.

7. The method of claim 1, wherein the p-phenylenediamine color developing agent is a compound represented by the following Formula (I):

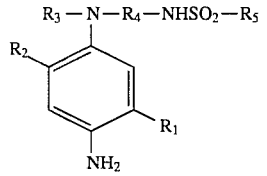

Formula (I)

wherein $R_1$ and $R_2$ independently represent a hydrogen atom, an alkyl group, an alkoxy group or an acylamino group; $R_3$ represents an alkyl group; $R_4$ represents an alkylene group; and $R_5$ represents a methyl group, an ethyl group, a methoxymethyl group, a dimethylamino group, a chloromethyl group, an acetylaminomethyl group or an ethoxymethyl group.

8. The method of claim 1, wherein the material comprises a silver halide emulsion comprising not less than 80 mol % of silver chloride in the silver halide composition.

9. The method of claim 1, wherein the solid color developing composition further comprises a compound represented by the following Formula (II):

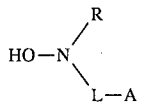

Formula (II)

wherein

L represents a methylene group or a substituted methylene group wherein the substituent is a carboxy group, a sulfo group, a phosphono group or a hydroxy group; an ethylene group or a substituted ethylene group wherein the substituent is a carboxy group, a sulfo group, a phosphono group or a hydroxy group; a trimethylene group or a substituted trimethylene group having a carboxy group, a sulfo group, a phosphono group or a hydroxy group; or a propylene group or a substituted propylene group wherein the substituent is a carboxy group, a sulfo group, a phosphono group or a hydroxy group;

A represents a carboxyl group, a sulfo group, a phosphono group, a phosphinic acid group, a hydroxyl group, an amino group, an ammonio group, a carbamoyl group or a sulfamoyl group; and R represents a hydrogen atom, a methyl group, an ethyl group, a propyl group, a carboxymethyl group, a carboxyethyl group, a carboxypropyl group, a sulfoethyl group, a sulfopropyl group, a sulfobutyl group, a phosphonomethyl group, a phosphonoethyl group or a hydroxyethyl group, provided that L and R may combine with each other to form a ring.

10. The method of claim 1, wherein the temperature of the color developer in the color development tank is controlled to be within a predetermined range.

11. The method of claim 1, wherein the replenishment of the solid color developing composition is conducted based on the information of the amount of the material which has been processed.

12. The method of claim 1, wherein the color developer in the color development tank is circulated through a passage connected to the tank.

13. The method of claim 12, wherein the color developer is filtered by a filter provided in the passage.

14. The method of claim 13, wherein the solid color developing composition is supplied to the passage before the color developer is filtered.

* * * * *